US008834205B2

(12) United States Patent
Fogg et al.

(10) Patent No.: US 8,834,205 B2
(45) Date of Patent: Sep. 16, 2014

(54) PLUGGABLE MODULE SYSTEM

(75) Inventors: Michael Warren Fogg, Harrisburg, PA (US); Steven David Dunwoody, Middletown, PA (US); Richard James Long, Columbia, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 153 days.

(21) Appl. No.: 13/553,460

(22) Filed: Jul. 19, 2012

(65) Prior Publication Data

US 2014/0024244 A1 Jan. 23, 2014

(51) Int. Cl.
*H01R 13/648* (2006.01)

(52) U.S. Cl.
USPC ..... 439/607.21

(58) Field of Classification Search
USPC ..... 439/607.2, 607.21
See application file for complete search history.

(56) References Cited

U.S. PATENT DOCUMENTS 6,524,134 B2 2/2003 Flickinger et al.
7,566,245 B1 * 7/2009 McColloch ..... 439/607.2
7,597,590 B2 * 10/2009 McColloch ..... 439/607.18
8,033,741 B2 * 10/2011 Yoshikawa ..... 385/92
8,123,559 B2 * 2/2012 Brown et al. ..... 439/607.21
8,545,267 B2 * 10/2013 Fogg et al. ..... 439/607.25
8,545,268 B2 * 10/2013 Fogg et al. ..... 439/607.25
8,613,632 B1 * 12/2013 Nichols ..... 439/607.21
2014/0024244 A1 * 1/2014 Fogg et al. ..... 439/352
2014/0030922 A1 * 1/2014 Schmitt et al. ..... 439/607.2

OTHER PUBLICATIONS

Michael D. Long, et al.; SFF-8432 Specification for Improved Pluggable Formfactor; Rev. 5.0; Jul. 16, 2007.; pp. 1-17.

* cited by examiner

*Primary Examiner* — James Harvey

(57) ABSTRACT

A pluggable module system includes an electrical connector assembly having a cage member with a plurality of walls defining a receptacle. The cage member has an opening in a front thereof providing access to the receptacle and a latch proximate to the opening. A receptacle connector is received in the cage member proximate to a rear thereof and is accessible in the receptacle. A pluggable module is received in the receptacle and is mated to the receptacle connector. The pluggable module has a conductive shell and a retention post that extends from the conductive shell. The retention post engages the latch to secure the pluggable module in the receptacle. The conductive shell has grounding tabs that extend from the shell. The grounding tabs circumferentially surround the conductive shell.

18 Claims, 6 Drawing Sheets

PLUGGABLE MODULE SYSTEM

BACKGROUND OF THE INVENTION

The subject matter herein relates generally to pluggable module systems for pluggable electronic modules, such as transceiver modules, for high speed electrical or opto-electric communications.

It is known to provide a metal cage with a plurality of receptacles, whereby transceiver modules are pluggable therein. Several pluggable module designs and standards have been introduced in which a pluggable module plugs into a receptacle connector which is electronically connected to a host circuit board. The transceivers provide an interface between a computer and a data communication network such as Ethernet or a fiber network. The transceivers may be either copper based or fiber optic based.

It is desirable to increase the receptacle density associated with the network connection, such as, for example, switch boxes, cabling patch panels, wiring closets, and computer I/O. One known standard is referred to as the small form factor pluggable (SFP) standard which specifies an enclosure height of 9.8 mm and a width of 13.5 mm and a minimum of 20 electrical input/output connections.

It is also desirable to increase the operating frequency of the network connection. For example, applications are moving to the multi-gigabit realm. Electrical connector systems that are used at increased operating speeds present a number of design problems, particularly in applications in which data transmission rates are high, e.g., in the range above 10 Gbs (Gigabits/second). One concern with such systems is reducing electromagnetic interference (EMI) emissions.

One known area of EMI leakage is at the interface between the pluggable module and the latch that holds the pluggable module in the receptacle. Some known pluggable modules include grounding clips or tabs that surround the top and sides of the pluggable modules to engage the cage that defines the receptacle. However, because the grounding tabs have the potential to snag or engage the latch on the cage, causing the pluggable module to be permanently held in the receptacle, the grounding tabs do not extend across the bottom of the pluggable module in the area aligned with the latch. Such area of the pluggable module is susceptible to EMI leakage.

A need remains for a pluggable module system that minimizes EMI emissions and provides a convenient pluggable operation.

BRIEF DESCRIPTION OF THE INVENTION

In one embodiment, a pluggable module system is provided having an electrical connector assembly having a cage member that has a plurality of walls that define a receptacle. The walls are manufactured from a metal material and provide electrical shielding for the receptacle. The cage member has an opening in a front thereof providing access to the receptacle. The cage member has a latch proximate to the opening. A receptacle connector is received in the cage member proximate to a rear thereof. The receptacle connector is accessible in the receptacle. A pluggable module is received in the receptacle and is mated to the receptacle connector. The pluggable module has a conductive shell and a retention post that extends from the conductive shell. The retention post engages the latch to secure the pluggable module in the receptacle. The conductive shell has grounding tabs that extend from the shell. The grounding tabs circumferentially surround the conductive shell.

Optionally, the grounding tabs may entirely circumferentially surround the conductive shell. The grounding tabs may be aligned axially behind the retention post. Optionally, the conductive shell may include an inner side, an outer side and opposite lateral sides, with the retention post extending from the inner side, and with the grounding tabs being uniformly spaced around the conductive shell along the inner side, the outer side and the opposite lateral sides. The grounding tabs may be arranged in a pattern along the outer side and in a complementary pattern along the inner side. The retention post may be substantially centrally located between the opposite lateral sides, and the grounding tabs may also be substantially centrally located between the opposite lateral sides.

Optionally, the grounding tabs may include front ends and rear ends. The grounding tabs aligned with, and behind, the retention post may have the front ends and the rear ends protected from catching on the latch when loading or unloading the pluggable module into or out of the receptacle. Optionally, the conductive shell may include at least one pocket, where the grounding tabs aligned with, and behind, the retention post have the front ends received in the at least one pocket. Optionally, the grounding tabs may be part of a grounding clip that is coupled to the conductive shell such that the grounding tabs are positioned axially behind the retention post with at least one grounding tab aligned directly behind the retention post. The grounding tabs may be integrally formed with the conductive shell.

In another embodiment, a pluggable module is provided having a conductive shell that extends between a plug end and a mating end. The plug end is configured to be received in a receptacle defined by a conductive cage and is configured to be electrically connected to a receptacle connector in the receptacle. The mating end defines an interface configured for connection with an electrical or opto-electric component. The shell has an inner side, an outer side and opposed lateral sides. A retention post extends from the inner side of the shell. The retention post is configured to engage a latch of the cage to hold the pluggable module in the receptacle. Grounding tabs extend from the shell and are provided on the inner side, the outer side and the opposite lateral sides to entirely circumferentially surround the shell. The grounding tabs are configured to engage the cage to provide shielding from electromagnetic interference.

DETAILED DESCRIPTION OF THE INVENTION

Figure 1:
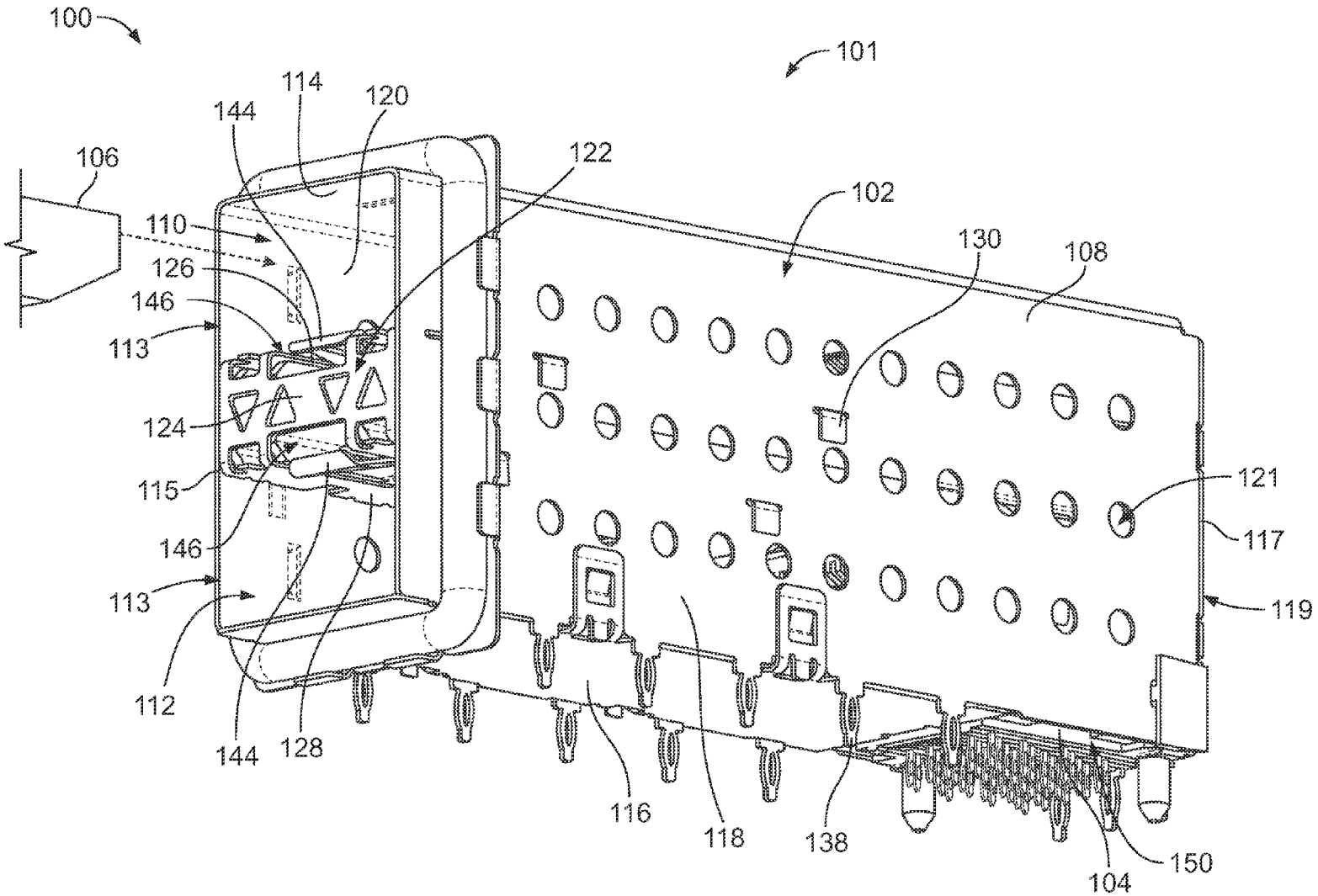
FIG. 1 is a front perspective view of a portion of a pluggable module system formed in accordance with an exemplary embodiment showing an electrical connector assembly thereof and a portion of a pluggable module poised for loading into the electrical connector assembly.

FIG. 1 is a front perspective view of a pluggable module system 100 formed in accordance with an exemplary embodiment. The pluggable module system 100 includes one or more electrical connector assemblies 101 and one or more pluggable modules 106 (shown in FIG. 3). The electrical connector assembly 101 includes a cage member 102 and a receptacle connector 104 received in the cage member 102. The cage member 102 is intended for placement on a circuit board, such as a motherboard, and provides electrical shielding for the receptacle connector 104 and the pluggable modules 106. The pluggable modules 106 are configured to be loaded into the cage member 102 for mating with the receptacle connector 104. The receptacle connector 104 is intended for placement on a circuit board, such as a motherboard, and is arranged within the cage member 102 for mating engagement with the pluggable modules 106.

The cage member 102 is a shielded, stamped and formed cage member that includes a plurality of shielded walls 108 that define multiple receptacles 110, 112 for receipt of the pluggable modules 106. In the illustrated embodiment, the cage member 102 constitutes a stacked cage member having the receptacles 110, 112 in a stacked configuration. The receptacle 110 defines an upper receptacle positioned above the receptacle 112 and may be referred to hereinafter as upper receptacle 110. The receptacle 112 defines a lower receptacle positioned below the receptacle 110 and may be referred to hereinafter as lower receptacle 112. Any number of receptacles may be provided in alternative embodiments. In the illustrated embodiment, the cage member 102 includes the receptacles 110, 112 arranged in a single column, however, the cage member 102 may include multiple columns of receptacles 110, 112 in alternative embodiments (e.g. 2×2, 3×2, 4×2, 4×3, etc.). In other alternative embodiments, the cage member 102 may include a single receptacle or may include receptacles arranged in a single row (e.g. non-stacked).

The cage member 102 includes a top wall 114, a lower wall 116, a rear wall 117 and side walls 118, 120, which together define the general enclosure for the cage member 102. The cage member 102 includes openings 113 in a front 115 thereof that provide access to the receptacles 110, 112. The rear wall 117 is provided at a rear 119 of the cage member 102. Optionally, the cage member 102 may not include the lower wall 116, but rather may have an open bottom. In an exemplary embodiment, the shielded walls 108 may include airflow openings 121 therethrough. The airflow openings 121 promote airflow through the shielded walls 108 to help cool the shielded walls 108, the receptacles 110, 112 and/or the pluggable modules 106. In an exemplary embodiment, the size, shape, spacing and/or positioning of the airflow openings 121 may be selected with consideration to thermal performance, shielding performance (e.g. electromagnetic interference (EMI) shielding), electrical performance, or other design considerations.

The cage member 102 is subdivided by a center separator member 122 to define the upper and lower receptacles 110, 112. The separator member 122 extends between the side walls 118, 120. The separator member 122 has a front wall 124 with an upper plate 126 and a lower plate 128 extending rearward from the front wall 124. A channel is defined between the upper and lower plates 126, 128 rearward of the front wall 124. The upper and lower plates 126, 128 are spaced apart from one another defining an air gap through the channel. The separator member 122 is retained in place by tabs 130, which extend through the side walls 118, 120.

The cage member 102 has numerous features allowing the grounding of the cage member 102 to a motherboard and/or a front bezel. The lower wall 116 and side walls 118, 120 include mounting posts or tines 138 extending therefrom that are configured to be received in plated ground vias of the motherboard to electrically ground the cage member 102 to the ground plane of the motherboard. The tines 138 are profiled to both mechanically hold the cage member 102 to the motherboard as well as to ground the cage member 102 thereto. Similar features may extend from the lower wall 116 and provide grounding of the cage member 102 to the motherboard. Around the perimeter of the cage member 102 towards the front edge thereof, the cage member 102 may include a plurality of resilient tabs, which are profiled to engage an edge of an opening through which the cage member 102 is inserted, such as an opening in a panel or chassis.

The separator member 122 includes latches 144 adjacent a front edge thereof for securing the pluggable modules 106 in the receptacles 110, 112. The latches 144 also provide a grounding path between the pluggable modules 106 and the cage member 102. The latches 144 have latch openings 146 for latching engagement with the pluggable modules 106. The latches 144 are deflectable and are stamped from the upper and lower plates 126, 128 of the separator member 122. For the upper receptacle 110, the latch 144 is provided at the bottom of the receptacle 110. For the lower receptacle 112, the latch 144 is provided at the top of the receptacle 112.

In an exemplary embodiment, the lower wall 116 is shorter than the other walls defining a rear opening 150 between the rear edge of the lower wall 116 and the rear wall 117. Alternatively, the rear opening 150 may extend through the lower wall 116. The receptacle connector 104 is received in the rear opening 150. In an exemplary embodiment, the receptacle connector 104 is accessible through the lower receptacle 112 and the upper receptacle 110. Alternatively, multiple receptacle connectors may extend into the cage member 102 into different receptacles 110, 112 for mating with corresponding pluggable modules 106. For example, two receptacle connectors may be provided, one extending into the lower receptacle 112, the other extending through the lower receptacle 112 into the upper receptacle 110.

Figure 2:
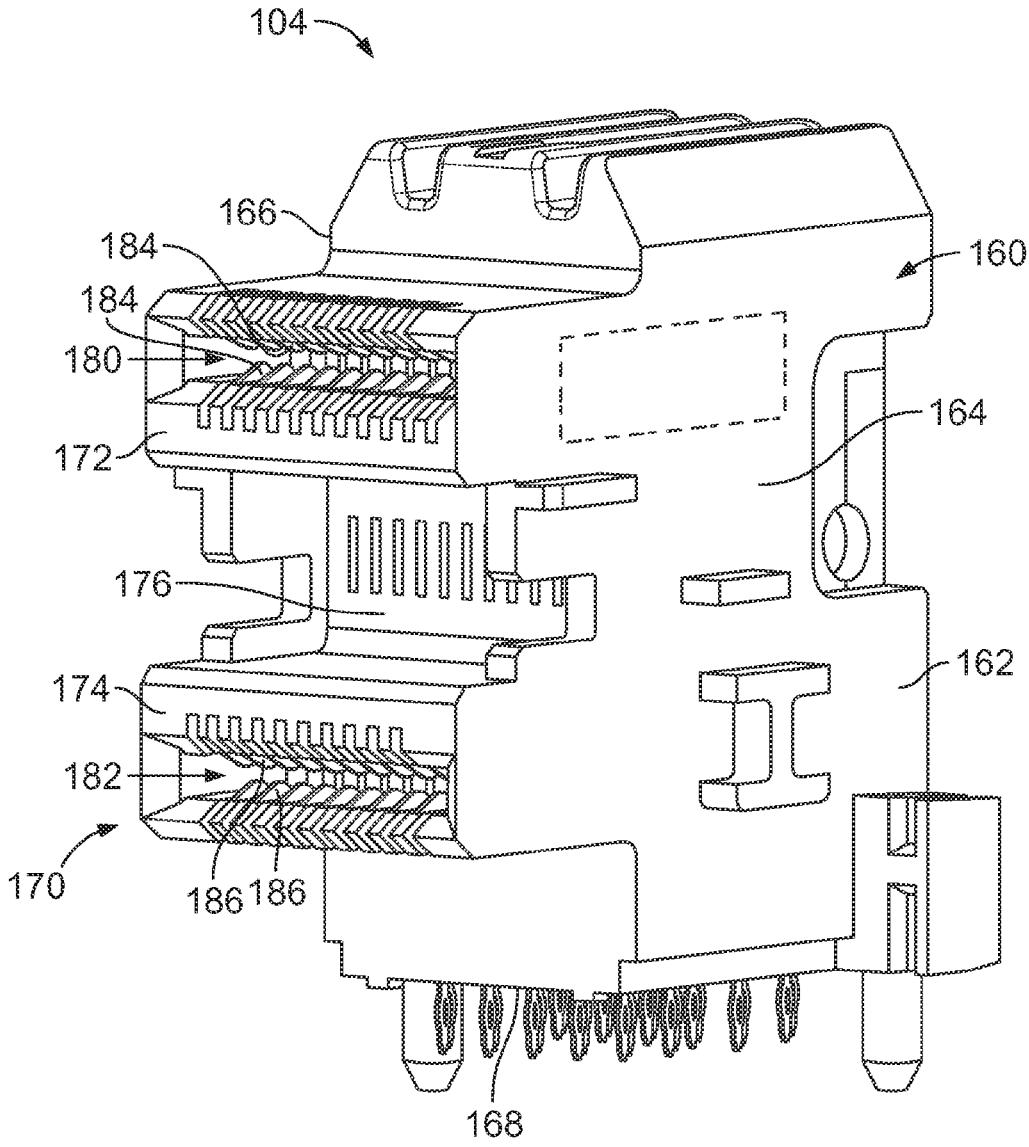
FIG. 2 is a front perspective view of a receptacle connector for the electrical connector assembly shown in FIG. 1.

FIG. 2 is a front perspective view of the receptacle connector 104. The receptacle connector 104 includes a housing 160 defined by an upstanding body portion 162 having side walls 164, 166, a lower face 168 configured to be mounted to the motherboard, and a mating face 170. Upper and lower extension portions 172 and 174 extend from the body portion 162 to define the mating face 170. A recessed face 176 is defined between the upper and lower extensions 172, 174 at the front face of the body portion 162.

Circuit card receiving slots 180 and 182 extend inwardly from the mating face 170 of each of the respective upper and lower extensions 172, 174, and extend inwardly to the housing body 160. The circuit card receiving slots 180, 182 are configured to receive a card edge of the pluggable module 106 (shown in FIGS. 3 and 4). A plurality of contacts 184 are held by the housing 160 and are exposed within the circuit card receiving slot 180 for mating with the corresponding pluggable module 106. The contacts 184 extend from the lower face 168 and are terminated to the motherboard. For example, the ends of the contacts 184 may constitute pins that are loaded into plated vias of the motherboard. Alternatively, the contacts 184 may be terminated to the motherboard in another manner, such as by surface mounting to the motherboard. A plurality of contacts 186 are held by the housing 160 and are exposed within the circuit card receiving slot 182 for mating with the corresponding pluggable module 106. The contacts 186 extend from the lower face 168 and are terminated to the motherboard.

Figure 3:
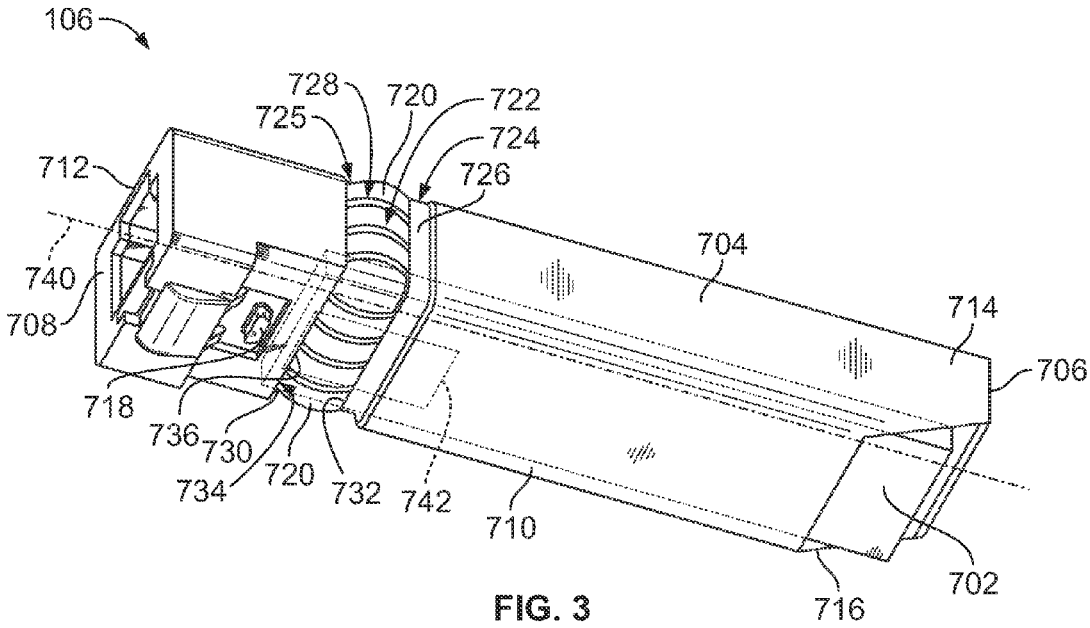
FIG. 3 is a front, bottom perspective view of a pluggable module for use with the electrical connector assembly shown in FIG. 1.
Figure 4:
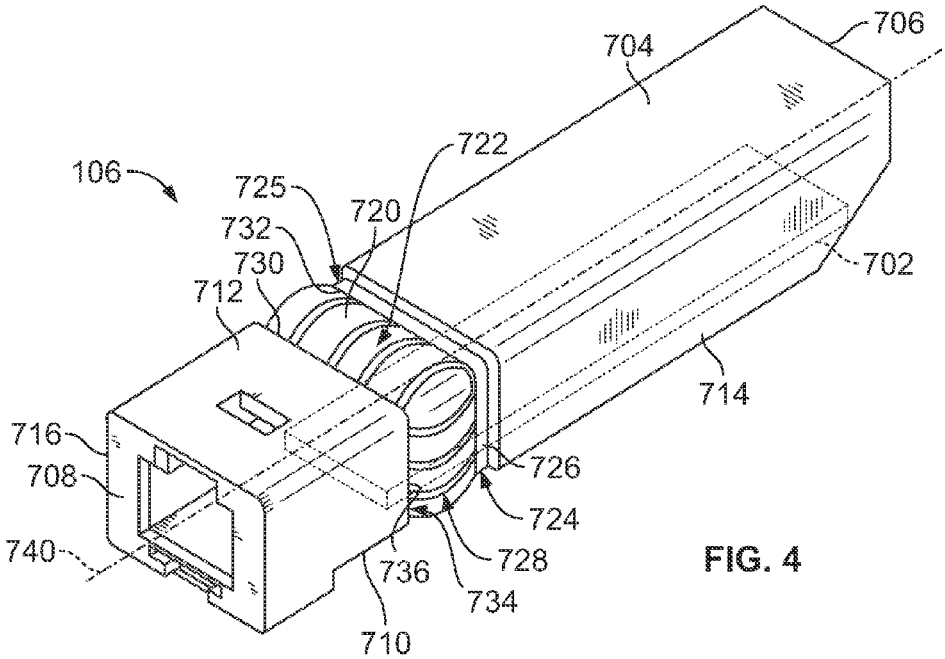
FIG. 4 is a front, top perspective view of the pluggable module shown in FIG. 3.

FIGS. 3 and 4 illustrate a pluggable module 106 for the pluggable module system 100 (shown in FIG. 1). FIG. 3 is a front, bottom perspective view of the pluggable module 106. FIG. 4 is a rear, top perspective view of the pluggable module 106. In the illustrated embodiment, the pluggable module 106 constitutes a small form-factor pluggable (SFP) module having a circuit card 702 for interconnection into the slots 180, 182 (shown in FIG. 2) and into interconnection with the contacts 184 or 186 (shown in FIG. 2) therein.

The pluggable module 106 includes a conductive shell 704. The circuit card 702 is held within the conductive shell 704. Optionally, the conductive shell 704 may be formed from two die-cast shell portions that are coupled together. Alternatively, the conductive shell 704 may be manufactured from one or more stamped and formed parts. The conductive shell 704 may be manufactured from a metallized plastic in other embodiments.

The conductive shell 704 includes a plug end 706 and a mating end 708. The plug end 706 defines a rear of the pluggable module 106 and is configured to be loaded into one of the receptacles 110, 112 (shown in FIG. 1). The plug end 706 is configured to be electrically connected to the receptacle connector 104 (shown in FIG. 2). The mating end 708 defines a front of the pluggable module 106. The mating end 708 defines an interface configured for connection with an electrical or opto-electric component. For example, the interface at the mating end 708 may be a fiber optic interface for connection with one or more fiber optic connectors. Alternatively, the interface at the mating end 708 may be a copper interface, such as in the form of a modular jack for receiving a modular plug.

The conductive shell 704 is generally rectangular in cross-section. The conductive shell 704 includes an inner side 710, an outer side 712 and opposite lateral sides 714, 716. The sides 710-716 define a perimeter of the conductive shell 704. The inner side 710 is the side that generally faces the latch 144 (shown in FIG. 1) when plugged into the corresponding receptacle 110, 112. In an exemplary embodiment, the inner side 710 includes a retention post 718 extending therefrom that is used to interface with the latch 144 to secure the pluggable module 106 in the receptacle 110, 112. In the orientation shown in FIGS. 3 and 4, the inner side 710 defines a bottom of the conductive shell 704 and the outer side 712 defines a top of the conductive shell 704. In other embodiments, the inner side 710 defines a top of the conductive shell 704 and the outer side 712 defines a bottom of the conductive shell 704. Other orientations are possible in alternative embodiments. Optionally, the conductive shell 704 may include more or less than the four sides 710-716 described herein giving the conductive shell 704 another, non-rectangular shape.

The pluggable module 106 includes grounding tabs 720 circumferentially surrounding the conductive shell 704. The grounding tabs 720 define a grounding band around the conductive shell 704. The grounding band is located axially rearward of the retention post 718. The grounding tabs 720 extend from the conductive shell 704 and are configured to engage corresponding shielded walls 108 (shown in FIG. 1) of the cage member 102 (shown in FIG. 1). For example, when the pluggable module 106 is loaded into the corresponding receptacle 110, 112, the grounding tabs 720 engage the shielded walls 108 to electrically connect the conductive shell 704 with the cage member 102. Many grounding tabs 720 are provided to allow multiple points of contact between the conductive shell 704 and the cage member 102. The grounding tabs 720 are deflectable and are configured to be spring biased against the shielded walls 108 to ensure engagement between the grounding tabs 720 and the cage member 102.

The grounding tabs 720 are positioned to minimize EMI leakage from the receptacle 110, 112. In an exemplary embodiment, the grounding tabs 720 entirely circumferentially surround the conductive shell 704 to provide 360° shielding. No gaps are provided at the grounding band. For example, grounding tabs 720 are provided along the inner side 710, the outer side 712 and both lateral sides 714, 716. The grounding tabs 720 may be uniformly spaced around the conductive shell 704. For example, the grounding tabs 720 have grounding interfaces 722 that are circumferentially spaced apart from one another at a predetermined distance or pitch. In an exemplary embodiment, the predetermined distance is the same between each adjacent grounding tab 720. For example, along the lateral sides 714, 716, the grounding tabs 720 are closely spaced at equal distances. The pattern of grounding tabs 720 may be the same on both lateral sides 714, 716. Along the outer side 712, the grounding tabs 720 are closely spaced at equal distances, which may be the same as the distances between the grounding tabs 720 on the lateral sides 714, 716. Similarly, along the inner side 710, the grounding tabs 720 are closely spaced at equal distances, which may be the same as the distances between the grounding tabs 720 on the lateral sides 714, 716. In an exemplary embodiment, the pattern of grounding tabs 720 on the inner side 710 is the complement to the pattern of grounding tabs 720 on the outer side 712. For example, the same number of grounding tabs 720 are provided on the inner side 710 as on the outer side 712, and the grounding tabs 720 on the inner side 710 are aligned with the grounding tabs 720 on the outer side 714. In an alternative embodiment, the grounding tabs 720 may not be spaced equidistant. A different number of tabs may be provided on the inner and outer sides 710, 712. A single grounding tab, without gaps, may be provided on the lateral sides 714, 716 and/or the inner and/or the outer sides 710, 712. The number and spacing of the grounding tabs 720 may be varied in different embodiments, while allowing for complete 360° shielding.

In an exemplary embodiment, the pluggable module 106 includes a grounding clip 724 that is separately provided from, and coupled to the conductive shell 704. The conductive shell 704 includes a channel 725, and the grounding clip 724 is received in the channel 725. The channel 725 locates the grounding clip 724 with respect to the conductive shell 704. The grounding tabs 720 are integral with the grounding clip 724. As such, the grounding tabs 720 are separately provided from, and coupled to the conductive shell 704. The grounding tabs 720 are electrically connected to the conductive shell 704. For example, the grounding clip 724 and/or the grounding tabs 720 may engage the conductive shell 704. The grounding tabs 720 extend outward from the conductive shell 704 such that the grounding tabs 720 have a larger envelope than the conductive shell 704 to ensure that the grounding tabs 720 engage the cage member 102. The grounding tabs 720 may be deflectable toward the conductive shell 704 when engaging the cage member 102.

The grounding clip 724 includes a band 726 that extends at least partially circumferentially around the conductive shell 704. Optionally, the grounding clip 724 may include multiple pieces that are coupled together, such as two bands that each extend partially around the conductive shell 704, but together extend completely around the conductive shell 704. Optionally, the grounding tabs 720 and band 726 are stamped and formed. Slots 728 are defined between adjacent grounding tabs 720. The slots 728 separate adjacent grounding tabs 720. In an exemplary embodiment, the slots 728 have equal widths between all the grounding tabs 720. As such, no large gaps are provided between any of the grounding tabs 720 and the grounding tabs 720 are able to provide 360° shielding. In alternative embodiments, the slots 728 may have different widths, but the slots 728 are relatively small so that no large gaps exist around the grounding clip 724.

In an alternative embodiment, rather than having a separate grounding clip 724, the grounding tabs 720 may be integrally formed with the conductive shell 704. For example, the grounding tabs 720 may be stamped and formed from the conductive shell 704 and extend from the corresponding sides 710-716.

Each grounding tab 720 extends between a front end 730 and a rear end 732. In the illustrated embodiment, the rear ends 732 are all attached at the band 726. The grounding tabs 720 are cantilevered from the band 726 with the front ends 730 being free floating and defining distal ends. In alternative embodiments, both the front and rear ends 730, 732 may be attached to the band 726 (e.g. the band 726 may be wider and provided on both ends of the grounding tabs 720 or two bands, a front band and a rear band, may be provided).

The conductive shell 704 includes a pocket 734 in the inner side 710. The front ends 730 of the grounding tabs 720 associated with the inner side 710 are received in the pocket 734. Optionally, the pocket 734 may be defined, at least in part, by the channel 725. The pocket 734 may be provided at the front of the channel 725. The pocket 734 includes a radial wall 736 extending radially outward from the conductive shell 704. The radial wall 736 may be the front wall of the channel 725. The radial wall 736 covers the front ends 730 of the grounding tabs 720. Optionally, the front ends 730 may engage the radial wall 736. The radial wall 736 protects the front ends 730 from snagging or catching on any surface or feature of the cage member 102 during loading and unloading of the pluggable module 106 into and out of the receptacle 110, 112. For example, the front ends 730 are recessed below the outer perimeter of the inner sides 710 into the pocket 734. In an exemplary embodiment, the radial wall 736 may protect the front end 730 from catching on the latch 144, which could lock the pluggable module 106 in the receptacle 110, 112. In an alternative embodiment, the pocket 734 may include an axial wall extending generally perpendicular with respect to the radial wall 736. The axial wall and the radial wall 736 may together define a chamber or cavity that receives the front ends 730 of the grounding tabs 720 to further protect and cover the front ends 730 of the grounding tabs 720.

Optionally, the outer side 712 and/or the lateral sides 714, 716 may also include pockets similar to the pocket 734 to protect the grounding tabs 720 associated with such sides 712-716. In an alternative embodiment, the grounding clip 724 may be configured such that the band 726 is provided at the front, with the front ends 730 extending from the band 726 and the rear ends 732 being free. The pocket 734 may be arranged at the other side of the channel 725 in such embodiment to protect the second ends 732.

The pluggable module 106 extends along a longitudinal axis 740 between the plug end 706 and the mating end 708 thereof. The retention post 718 extends from the inner side 710 proximate to the mating end 708. The retention post 718 is substantially centered between the opposite sides 714, 716. In an exemplary embodiment, the grounding tabs 720 are positioned rearward of the retention post 718. The grounding tabs 720 are aligned directly behind the retention post 718 in a latch path area, generally identified at 742. The latch path area 742 is the area that passes over the latch 144 during loading and unloading of the pluggable module 106 into and out of the receptacle 110, 112. The latch path area 742 is aligned directly behind the retention post 718. The latch path area 742 is substantially centered between the opposite sides 714, 716. No gap between grounding tabs 720 is provided behind the retention post 718 in the latch patch area 742. Rather, the grounding tabs 720 span across the latch path area 742 and provide EMI shielding in the latch path area 742. Some of the grounding tabs 720 are substantially centered between the opposite sides 714, 716.

When the pluggable module 106 is loaded into and unloaded from the receptacle 110, 112, the grounding tabs 720 that are in the latch path area 742 pass over the latch 144. The front ends 730 are protected from snagging on the latch 144 by the pocket 734. Other features may be provided in alternative embodiments to protect such grounding tabs 720 and prevent snagging or catching. For example, a feature may be provided that depresses the latch as the grounding tabs 720 pass over the latch 144.

Figure 5:
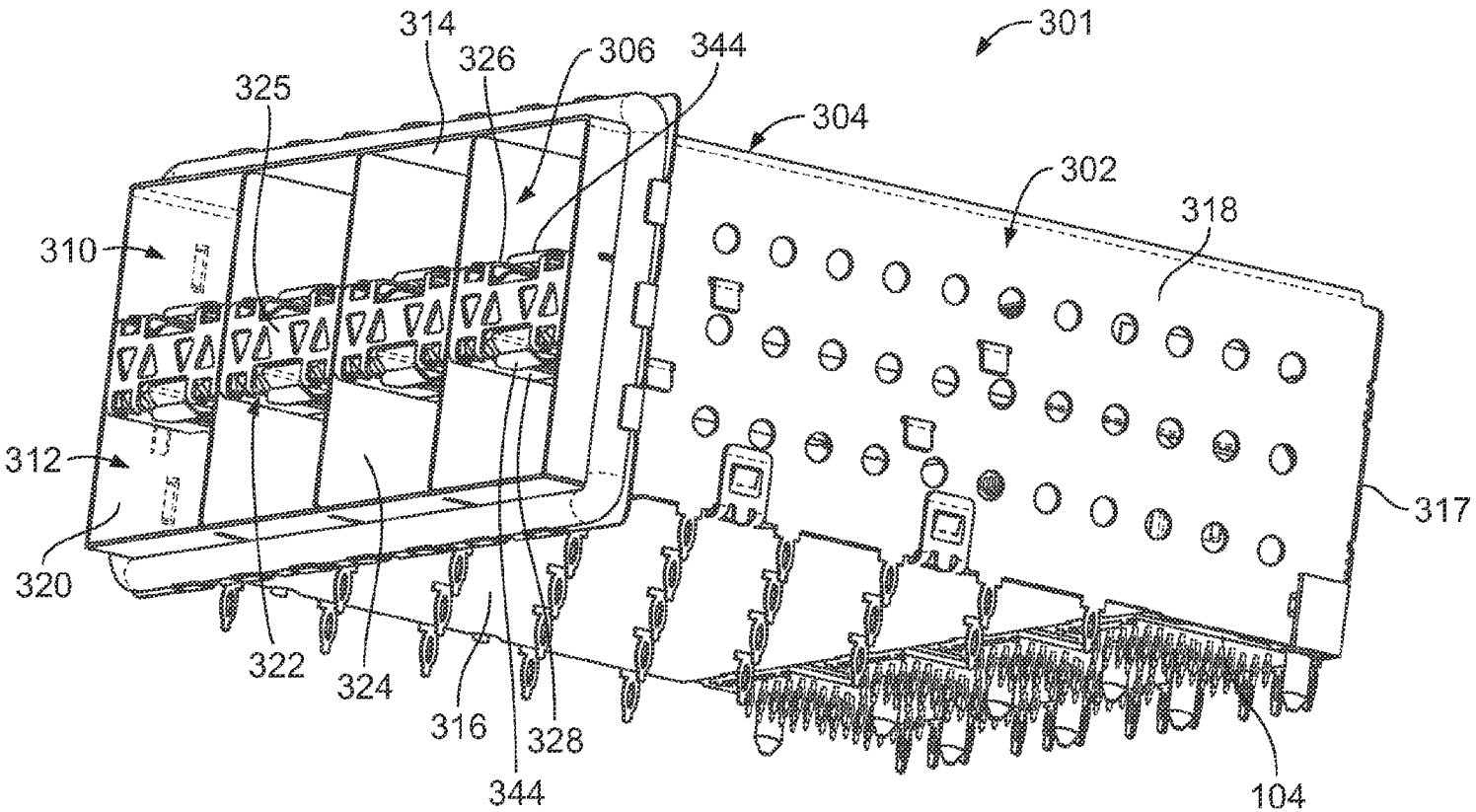
FIG. 5 is a front perspective view from an underside of an electrical connector assembly formed in accordance with an exemplary embodiment.

FIG. 5 is a front perspective view from an underside of an alternative electrical connector assembly 301 showing a cage member 302 and a plurality of the receptacle connectors 104. Pluggable modules 106 (shown in FIGS. 3 and 4) are configured to be loaded into the cage member 302 for mating with the receptacle connector 104.

The cage member 302 is a shielded, stamped and formed cage member that includes a plurality of exterior shielded walls 304 and a plurality of interior shielded walls 306 defining the cage member 302. The cage member 302 differs from the cage member 102 (shown in FIG. 1) in that the cage member 302 includes more receptacles. The cage member 302 includes a plurality of upper receptacles 310 and a plurality of lower receptacles 312. While four columns of receptacles 310, 312 are shown, it is realized that any number of columns of receptacles may be provided in alternative embodiments.

The exterior shielded walls 304 include a top wall 314, a lower wall 316, a rear wall 317 and side walls 318, 320, which together define the general enclosure for the cage member 302. The interior shielded walls 306 include separator members 322 between the rows of receptacles 310, 312 and divider walls 324 between the columns of receptacles 310, 312. The separator members 322 extend between one of the side walls 318, 320 and one of the divider walls 324 or between adjacent ones of the divider walls 324.

The separator member 322 has a front wall 325 with an upper plate 326 and a lower plate 328 extending rearward from the front wall 325. A channel is defined between the upper and lower plates 326, 328 rearward of the front wall 325. Latches 344 are provided in both the upper and lower plates 326, 328 for securing pluggable modules 106 in the upper receptacles 310 and the lower receptacles 312, respectively.

Figure 6:
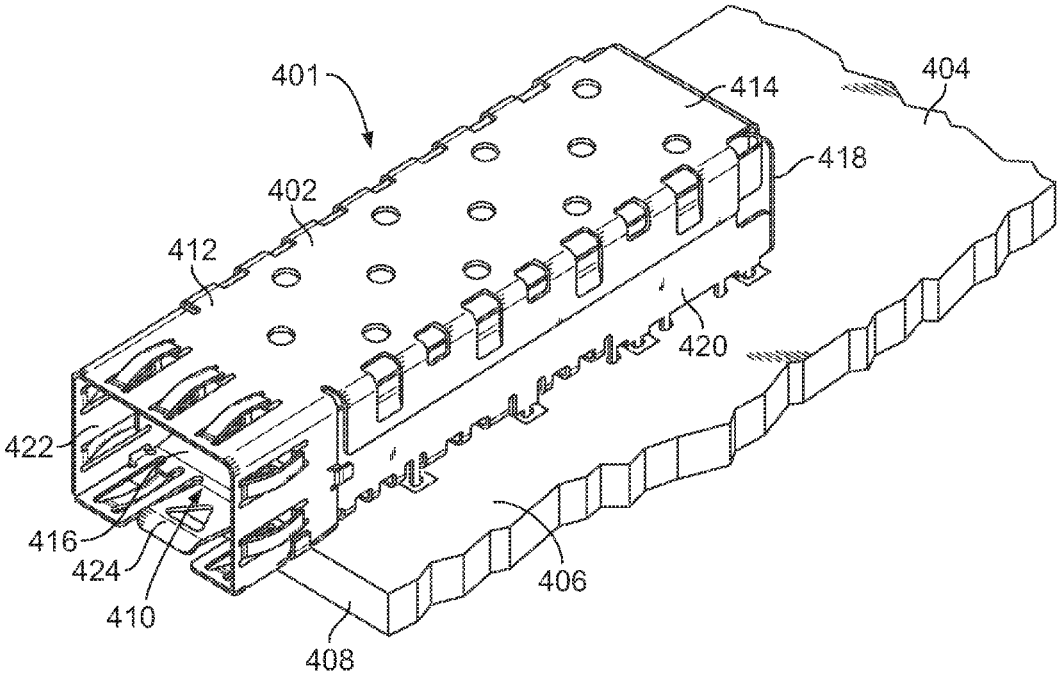
FIG. 6 is a top, front perspective view of an electrical connector assembly formed in accordance with an exemplary embodiment.

FIG. 6 is a top, front perspective view of an alternative electrical connector assembly 401 showing a cage member 402 mounted to a circuit board 404. The cage member 402 is mounted to a surface 406 of the circuit board 404 proximate to a front edge 408 thereof. The cage member 402 includes a single receptacle 410. One of the pluggable modules 106 (shown in FIGS. 3 and 4) is configured to be loaded into the receptacle 410. A receptacle connector (not shown) configured for use with a single receptacle would be mounted to the circuit board 404 and housed within the cage member 402.

The cage member 402 is a shielded, stamped and formed cage member that includes a plurality of shielded walls 412, including a top wall 414, a lower wall 416, a rear wall 418 and side walls 420 and 422, which together define the general enclosure for the cage member 402. A latch 424 is provided in the lower wall 416 for securing the pluggable module 106 in the receptacle 410.

Figure 7:
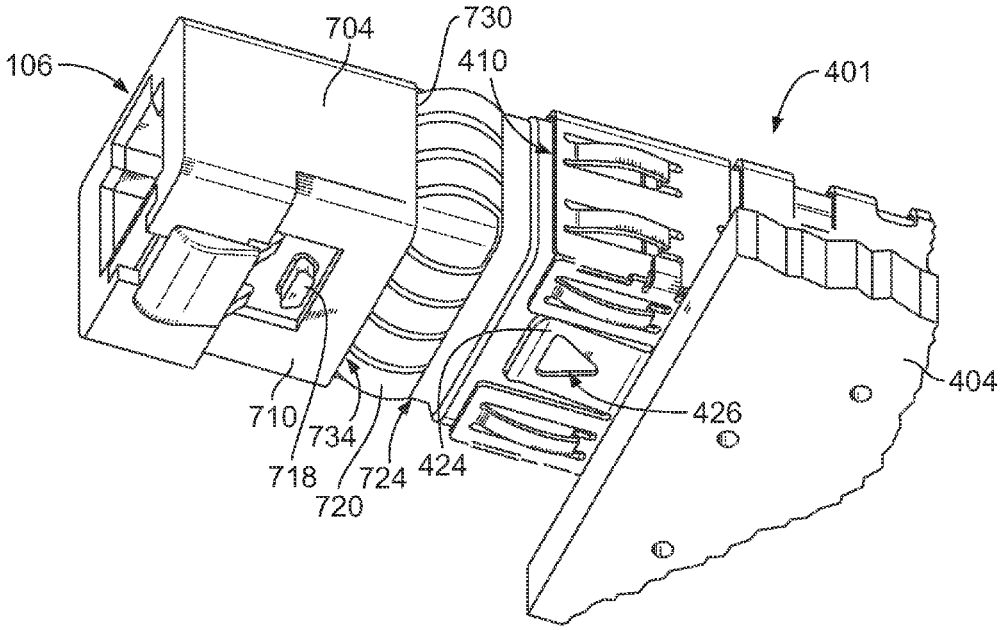
FIG. 7 is a bottom perspective view of a portion of the electrical connector assembly shown in FIG. 6, illustrating the pluggable module shown in FIGS. 3 and 4 being loaded therein.

FIG. 7 is a bottom perspective view of a portion of the electrical connector assembly 401 mounted to the circuit board 404, illustrating a pluggable module 106 being loaded into the receptacle 410. The retention post 718 extends from the inner side 710 of the conductive shell 704. The grounding clip 724 and grounding tabs 720 are positioned behind the retention post 718. The grounding tabs 720 along the inner side 710 are aligned with the latch 424 and pass over the latch 424 as the pluggable module 106 is loaded into and unloaded from the receptacle 410. The pocket 734 protects the front ends 730 of the grounding tabs 720 from snagging or catching on the latch 424. For example, the front ends 730 are protected from entering a latch opening 426 in the center of the latch 424. When the pluggable module 106 is fully loaded into the receptacle 410, the retention post 718 is received in the opening 426 to secure the pluggable module 106 within the receptacle 410.

Figure 8:
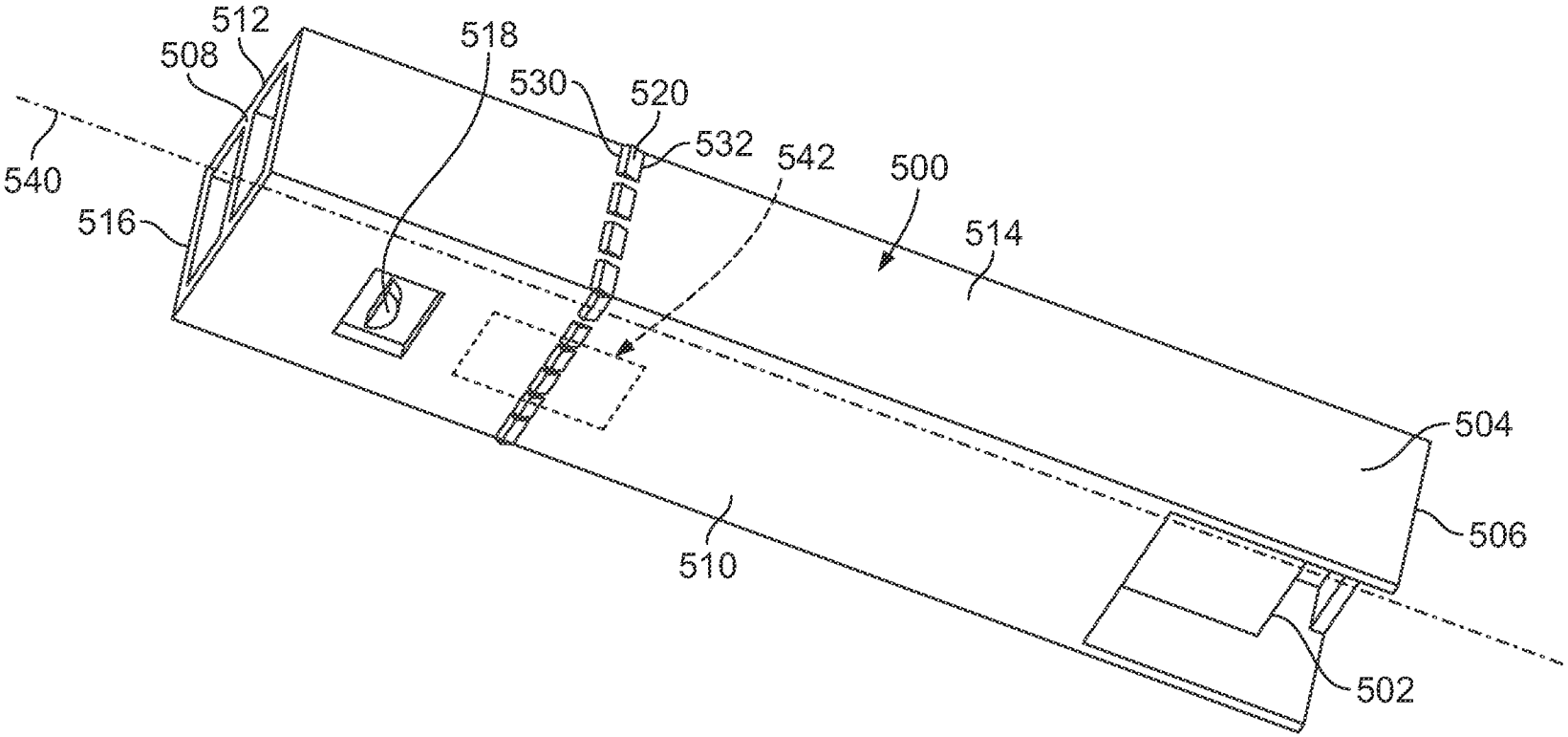
FIG. 8 is a bottom perspective view of a pluggable module formed in accordance with an exemplary embodiment.

FIG. 8 is a bottom perspective view of a pluggable module 500 formed in accordance with an exemplary embodiment. The pluggable module 500 is an optical pluggable module configured to interface with one or more fiber optic connectors (not shown). The optical pluggable module 500 includes a circuit card 502 for interconnection into the slots 180, 182 (shown in FIG. 2) and into interconnection with the contacts 184 or 186 (shown in FIG. 2) therein.

The pluggable module 500 includes a conductive shell 504. The circuit card 502 is held within the conductive shell 504. The conductive shell 504 includes a plug end 506 and a mating end 508. The plug end 506 defines a rear of the pluggable module 500 and is configured to be loaded into one of the receptacles 110, 112 (shown in FIG. 1), the receptacles 310, 312 (shown in FIG. 5) or the receptacle 410 (shown in FIG. 6). The mating end 508 defines a front of the pluggable module 500. The mating end 508 defines an interface configured for connection with an opto-electric component, such as a fiber optic connector.

The conductive shell 504 is generally rectangular in cross-section. The conductive shell 504 includes an inner side 510, an outer side 512 and opposite lateral sides 514, 516. In an exemplary embodiment, the inner side 510 includes a retention post 518 extending therefrom that is used to interface with a latch, such as the latch 144 (shown in FIG. 1).

The pluggable module 500 includes grounding tabs 520 circumferentially surrounding the conductive shell 504. The grounding tabs 520 define a grounding band around the conductive shell 504. The grounding band is positioned axially rearward of the retention post 518. The grounding tabs 520 extend from the conductive shell 504 and are configured to engage corresponding shielded walls 108 (shown in FIG. 1) of the cage member 102 (shown in FIG. 1). The grounding tabs 520 are deflectable and are configured to be spring biased against the shielded walls 108 to ensure engagement between the grounding tabs 520 and the cage member 102. The grounding tabs 520 are positioned to minimize EMI leakage from the receptacle 110, 112. In an exemplary embodiment, the grounding tabs 520 entirely circumferentially surround the conductive shell 504 to provide 360° shielding. No gaps are provided at the grounding band. For example, grounding tabs 520 are provided along the inner side 510, the outer side 512 and both lateral sides 514, 516. The grounding tabs 520 are aligned directly behind the retention post 518.

In the illustrated embodiment, the grounding tabs 520 are integrally formed with the conductive shell 504. Optionally, the grounding tabs 520 may be formed by swaging the conductive shell 504 to include protrusions or features that define the grounding tabs 520 and that increase the cross-section of the conductive shell 504. The grounding tabs 520 are connected to the conductive shell 504 at both a front end 530 and a rear end 532 of the grounding tabs 520. The grounding tabs 520 may be formed by other methods in alternative embodiments. For example, the conductive shell 504 may be stamped to create cantilevered spring fingers that define the grounding tabs 520. In such embodiments, either the front ends 530 or the rear ends 532 may define the distal or free ends of the grounding tabs 520. The free ends may be protected, such as by capturing the free ends, such as in a pocket, by recurving the free ends, or by providing other features that ensure the grounding tabs 520 do not engage, interfere with and/or catch the latch 144.

In an alternative embodiment, the grounding tabs 520 may be separate and discrete from the conductive shell 504 and electrically connected thereto. For example, the grounding contacts 520 may be part of a grounding clip (not shown) that is coupled to the conductive shell 504.

The pluggable module 500 extends along a longitudinal axis 540 between the plug end 506 and the mating end 508 thereof. The retention post 518 extends from the inner side 510 proximate to the mating end 508. The retention post 518 is substantially centered between the opposite sides 514, 516. In an exemplary embodiment, the grounding tabs 520 are positioned rearward of the retention post 518. The grounding tabs 520 are aligned directly behind the retention post 518 in a latch path area, generally identified at 542. No gap between grounding tabs 520 is provided behind the retention post 518 in the latch patch area 542. Rather, the grounding tabs 520 span across the latch path area 542 and provide EMI shielding in the latch path area 542. Some of the grounding tabs 520 are substantially centered between the opposite sides 514, 516.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A pluggable module system comprising:

an electrical connector assembly having a cage member having a plurality of walls defining a receptacle, the walls being manufactured from a metal material and providing electrical shielding for the receptacle, the cage member having an opening in a front thereof providing access to the receptacle, the cage member having a latch proximate to the opening;

a receptacle connector received in the cage member proximate to a rear thereof, the receptacle connector being accessible in the receptacle; and a pluggable module received in the receptacle and mated to the receptacle connector, the pluggable module having a conductive shell and a retention post extending from the conductive shell, the retention post engaging the latch to secure the pluggable module in the receptacle, the conductive shell having grounding tabs extending from the shell, the grounding tabs circumferentially surrounding the conductive shell, wherein the grounding tabs are aligned axially behind the retention post.

2. The pluggable module system of claim 1, wherein the grounding tabs entirely circumferentially surround the conductive shell.

3. A pluggable module comprising:

a conductive shell extending between a plug end and a mating end, the plug end being configured to be received in a receptacle defined by a conductive cage and being configured to be electrically connected to a receptacle connector in the receptacle, the mating end defining an interface configured for connection with an electrical or opto-electric component, the shell having an inner side, an outer side and opposed lateral sides;

a retention post extending from the inner side of the shell, the retention post configured to engage a latch of the cage to hold the pluggable module in the receptacle; and grounding tabs extending from the shell, the grounding tabs being provided on the inner side, the outer side and the opposite lateral sides to entirely circumferentially surround the shell, the grounding tabs being configured to engage the cage to provide shielding from electromagnetic interference, wherein the grounding tabs are aligned axially behind the retention post.

4. The pluggable module system of claim 1, wherein the conductive shell includes an inner side, an outer side and opposite lateral sides, the retention post extending from the inner side, the grounding tabs being uniformly spaced around the conductive shell along the inner side, the outer side and the opposite lateral sides.

5. The pluggable module system of claim 1, wherein the conductive shell includes an inner side, an outer side and opposite lateral sides, the retention post extending from the inner side, the grounding tabs being arranged in a pattern along the Outer side and in a complementary pattern along the inner side.

6. The pluggable module system of claim 1, wherein the pluggable module extends along a longitudinal axis between a plug end and a mating end, the grounding tabs being aligned with the retention post along the longitudinal axis and being positioned behind the retention post.

7. The pluggable module system of claim 1, wherein the conductive shell includes an inner side, an outer side and opposite lateral sides, the retention post extending from the inner side substantially centrally located between the opposite lateral sides, the grounding tabs extending from the inner side substantially centrally located between the opposite lateral sides.

8. The pluggable module system of claim 1, wherein the grounding tabs include front ends and rear ends, the grounding tabs aligned with, and behind, the retention post having the front ends and the rear ends protected from catching on the latch when loading or unloading the pluggable module into or out of the receptacle.

9. The pluggable module system of claim 1, wherein the conductive shell includes at least one pocket, the grounding tabs include front ends and rear ends, the grounding tabs aligned with, and behind, the retention post having the front ends received in the at least one pocket.

10. The pluggable module system of claim 1, further comprising a grounding clip, the grounding tabs being part of the grounding clip, the grounding clip being coupled to the conductive shell such that the grounding tabs are positioned axially behind the retention post with at least one grounding tab aligned directly behind the retention post.

11. The pluggable module system of claim 1, wherein the grounding tabs are integrally formed with the conductive shell.

12. The pluggable module system of claim 1, wherein the conductive shell includes an inner side, an outer side and opposite lateral sides, the retention post extending from the inner side, the grounding tabs being spaced apart from each other by a predetermined distance, the predetermined distance being the same between each of the grounding tabs along the inner side.

13. The pluggable module of claim 3, further comprising a grounding clip, the grounding tabs being part of the grounding clip, the grounding clip being coupled to the conductive shell such that the grounding tabs are positioned axially behind the retention post with at least one grounding tab aligned directly behind the retention post.

14. The pluggable module of claim 3, wherein the grounding tabs are integrally formed with the conductive shell.

15. The pluggable module of claim 3, wherein the grounding tabs are arranged in a pattern along the outer side and in a complementary pattern along the inner side.

16. The pluggable module of claim 3, wherein the retention post is substantially centrally located between the opposite lateral sides, the grounding tabs being substantially centrally located between the opposite lateral sides.

17. The pluggable module of claim 3, wherein the grounding tabs include front ends and rear ends, the grounding tabs aligned with, and behind, the retention post having the front ends and the rear ends protected from catching on the latch when loading or unloading the pluggable module into or out of the receptacle.

18. The pluggable module of claim 3, wherein the conductive shell includes at least one pocket, the grounding tabs include front ends and rear ends, the grounding tabs aligned with, and behind, the retention post having the front ends received in the at least one pocket.

* * * * *